US008581795B2

(12) United States Patent
Simms et al.

(10) Patent No.: US 8,581,795 B2
(45) Date of Patent: Nov. 12, 2013

(54) LOW SIDELOBE REFLECTOR ANTENNA

(75) Inventors: Stephen W Simms, Dunferminline (GB); Ronald J Brandau, Homer Glen, IL (US); Junaid Syed, Kirkcaldy (GB); Douglas John Cole, Powmill (GB); Chistopher D Hills, Glenrothes (GB)

(73) Assignee: Andrew LLC, Hickory, NC (US)

( * ) Notice: Subject to any disclaimer, the term of this patent is extended or adjusted under 35 U.S.C. 154(b) by 310 days.

(21) Appl. No.: 13/229,829

(22) Filed: Sep. 12, 2011

(65) Prior Publication Data

US 2013/0057445 A1 Mar. 7, 2013

Related U.S. Application Data

(63) Continuation-in-part of application No. 13/224,066, filed on Sep. 1, 2011.

(51) Int. Cl.
*H01Q 13/00* (2006.01)

(52) U.S. Cl.
USPC ..... 343/781 CA; 343/781 P

(58) Field of Classification Search
USPC ..... 343/781 R, 781 P, 781 CA, 779, 784
See application file for complete search history.

(56) References Cited

U.S. PATENT DOCUMENTS

| | | | |
|---|---|---|---|
| 2,605,416 | A | 7/1952 | Foster |
| 3,733,609 | A | 5/1973 | Bartlett |
| 4,673,945 | A | 6/1987 | Syrigos |
| 4,673,947 | A | 6/1987 | Newham |
| 4,963,878 | A | 10/1990 | Kildal |
| 5,907,310 | A | 5/1999 | Seewig et al. |
| 5,959,590 | A | 9/1999 | Sanford et al. |
| 5,973,652 | A | 10/1999 | Sanford et al. |
| 6,020,859 | A | 2/2000 | Kildal |
| 6,107,973 | A | 8/2000 | Knop et al. |
| 6,137,449 | A | 10/2000 | Kildal |
| 6,429,826 | B2 | 8/2002 | Karlsson et al. |
| 6,456,253 | B1 | 9/2002 | Rummeli et al. |
| 6,522,305 | B2 | 2/2003 | Sharman |
| 6,697,027 | B2 | 2/2004 | Mahon |
| 6,724,349 | B1 | 4/2004 | Baird et al. |
| 6,862,000 | B2 | 3/2005 | Desargant et al. |
| 6,919,855 | B2 | 7/2005 | Hills |
| 6,985,120 | B2 | 1/2006 | Lewry et al. |
| 6,995,727 | B2 | 2/2006 | Tuau et al. |
| 7,138,958 | B2 | 11/2006 | Syed et al. |
| 7,907,097 | B2 | 3/2011 | Syed et al. |

(Continued)

OTHER PUBLICATIONS

Schwering et al., Dielectric Omni-Directional Antennas, US Statutory Invention Registration No. H584, Feb. 7, 1987.

(Continued)

*Primary Examiner* — Hoanganh Le
(74) *Attorney, Agent, or Firm* — Babcock IP, PLLC

(57) ABSTRACT

A front feed reflector antenna with a dish reflector has a reflector focal length to reflector diameter ratio of less than 0.25. A wave guide is coupled to a proximal end of the dish reflector, projecting into the dish reflector along a longitudinal axis. A dielectric block is coupled to a distal end of the waveguide and a sub-reflector is coupled to a distal end of the dielectric block. A shield is coupled to the periphery of the dish reflector. The sub-reflector diameter is dimensioned to be 2.5 wavelengths or more of a desired operating frequency.

20 Claims, 16 Drawing Sheets

(56) References Cited

U.S. PATENT DOCUMENTS

| | | | | |
|---|---|---|---|---|
| 2002/0008670 | A1 | 1/2002 | Sharman | |
| 2005/0007288 | A1 | 1/2005 | Tuau | |
| 2005/0017916 | A1 | 1/2005 | Lewry | |
| 2005/0062663 | A1 | 3/2005 | Hills | |
| 2009/0021442 | A1 | 1/2009 | Syed et al. | |
| 2009/0184886 | A1 | 7/2009 | Tuau et al. | |
| 2010/0315307 | A1 | 12/2010 | Syed et al. | |
| 2011/0140983 | A1 | 6/2011 | Hills et al. | |
| 2011/0309987 | A1* | 12/2011 | Haluba et al. | 343/755 |
| 2012/0287007 | A1* | 11/2012 | Hills et al. | 343/781 P |

OTHER PUBLICATIONS

International Search Report, counterpart application No. PCT/US12/41884, Jan. 9, 2013, Korea Intellectual Property Office, Daejeon Metropolitan City, Republic of Korea.

International Search Report, related application no: PCT/US12/41879, Jul. 24, 2013, Korea Intellectual Property Office, Daejeon Metropolitan City, Republic of Korea.

* cited by examiner

| | Bottom freq (17.7GHz) | Mid freq (18.7GHz) | Top freq (19.7GHz) |
|---|---|---|---|
| **Straight** | 71 | 66 | 68 |
| **5° taper in** | 68 | 63 | 65 |
| **10° taper in** | 63 | 59 | 61 |

LOW SIDELOBE REFLECTOR ANTENNA

CROSS REFERENCE TO RELATED APPLICATIONS

This application is a continuation-in-part of commonly owned co-pending U.S. Utility patent application Ser. No. 13/224,066, titled "Controlled Illumination Dielectric Cone Radiator for Reflector Antenna", filed Sep. 1, 2011 by Ronald J. Brandau and Christopher D. Hills, currently pending and hereby incorporated by reference in its entirety.

BACKGROUND

1. Field of the Invention

This invention relates to a microwave dual reflector antenna. More particularly, the invention provides a low cost, self-supported front feed reflector antenna with a low sidelobe signal radiation pattern characteristic configurable for the reflector antenna to satisfy rigorous radiation pattern envelope standards, such as the European Telecommunications Standards Institute (ETSI) Class 4.

2. Description of Related Art

Front feed dual reflector antennas direct a signal incident on the main reflector onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern envelope, cross-polarization and return loss performance—efficient gain, radiation pattern envelope and cross-polarization characteristics are essential for efficient microwave link planning and coordination, whilst a good return loss is necessary for efficient radio operation.

Reflector antennas with a narrow radiation pattern envelope enable higher density mounting of separate reflector antennas upon a common support structure, such as a radio tower, without generating RF interference between the separate point-to-point communications links. Narrow radiation pattern envelope communications links also provide the advantage of enabling radio frequency spectrum allocations to be repeatedly re-used at the same location, increasing the number of links available for a given number of channels.

Industry accepted standard measures of an antenna's radiation pattern envelope (RPE) are provided for example by ETSI. ETSI provides four RPE classifications designated Class 1 through Class 4, of which the Class 4 specification is the most rigorous. The ETSI Class 4 RPE specification requires significant improvement over ETSI Class 3 RPE specification. As shown in FIGS. 1*a* and 1*b*, the ETSI Class 4 RPE requires approximately 10-12 dB improvements in sidelobe levels over ETSI Class 3 RPE requirements, resulting in a 35-40% increase in the number of links that can be assigned without additional frequency spectrum usage.

Previously, reflector antennas satisfying the ETSI Class 4 specification have been Gregorian dual reflector offset type reflector antennas, for example as shown in FIG. 1*c*. The dual offset configuration positions the sub-reflector 15 entirely outside of the signal path from the main reflector 50 to free space, which requires extensive additional structure to align and/or fully enclose the large optical system. Further, because of the non-symmetric nature of the dual offset configuration, an increased level of manufacturing and/or assembly precision is required to avoid introducing cross-polar discrimination interference. These additional structure and/or path alignment tuning requirements significantly increase the overall size and complexity of the resulting antenna assembly, thereby increasing the manufacturing, installation and ongoing maintenance costs.

Deep dish reflectors are reflector dishes wherein the ratio of the reflector focal length (F) to reflector diameter (D) is made less than or equal to 0.25 (as opposed to an F/D of 0.35 typically found in more conventional "flat" dish designs). An example of a dielectric cone feed sub-reflector configured for use with a deep dish reflector is disclosed in commonly owned U.S. Pat. No. 6,919,855, titled "Tuned Perturbation Cone Feed for Reflector Antenna" issued Jul. 19, 2005 to Hills (U.S. Pat. No. 6,919,855), hereby incorporated by reference in its entirety. U.S. Pat. No. 6,919,855 utilizes a dielectric block cone feed with a sub-reflector surface and a leading cone surface having a plurality of downward angled non-periodic perturbations concentric about a longitudinal axis of the dielectric block. The cone feed and sub-reflector diameters are minimized where possible, to prevent blockage of the signal path from the reflector dish to free space. Although a significant improvement over prior designs, such configurations have signal patterns in which the sub-reflector edge and distal edge of the feed boom radiate a portion of the signal broadly across the reflector dish surface, including areas proximate the reflector dish periphery and/or a shadow area of the sub-reflector where secondary reflections with the feed boom and/or sub-reflector may be generated, degrading electrical performance. Further, the plurality of angled features and/or steps in the dielectric block requires complex manufacturing procedures which increase the overall manufacturing cost.

A deep dish type reflector dish extends the length (along the boresight axis) of the resulting reflector antenna so that the distal end of the reflector dish tends to function as a cylindrical shield. Therefore, although common in the non-deep dish reflector antennas, conventional deep dish reflector antenna configurations such as U.S. Pat. No. 6,919,855 typically do not utilize a separate forward projecting cylindrical shield.

Therefore it is an object of the invention to provide a simplified reflector antenna apparatus which overcomes limitations in the prior art, and in so doing present a solution that enables a self supported sub-reflector front feed reflector antenna to meet the most stringent radiation pattern envelope electrical performance over the entire operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that improvements in primary radiation pattern control obtained from dielectric cone sub-reflector assemblies dimensioned to concentrate signal energy upon a mid-wall area of a deep dish reflector dish, paired with improved shielding at the reflector dish periphery can enable a cost effective self supported sub-reflector front feed type reflector antenna to meet extremely narrow radiation pattern envelope electrical performance specifications, such as the ETSI Class 4 RPE.

Figure 1A:
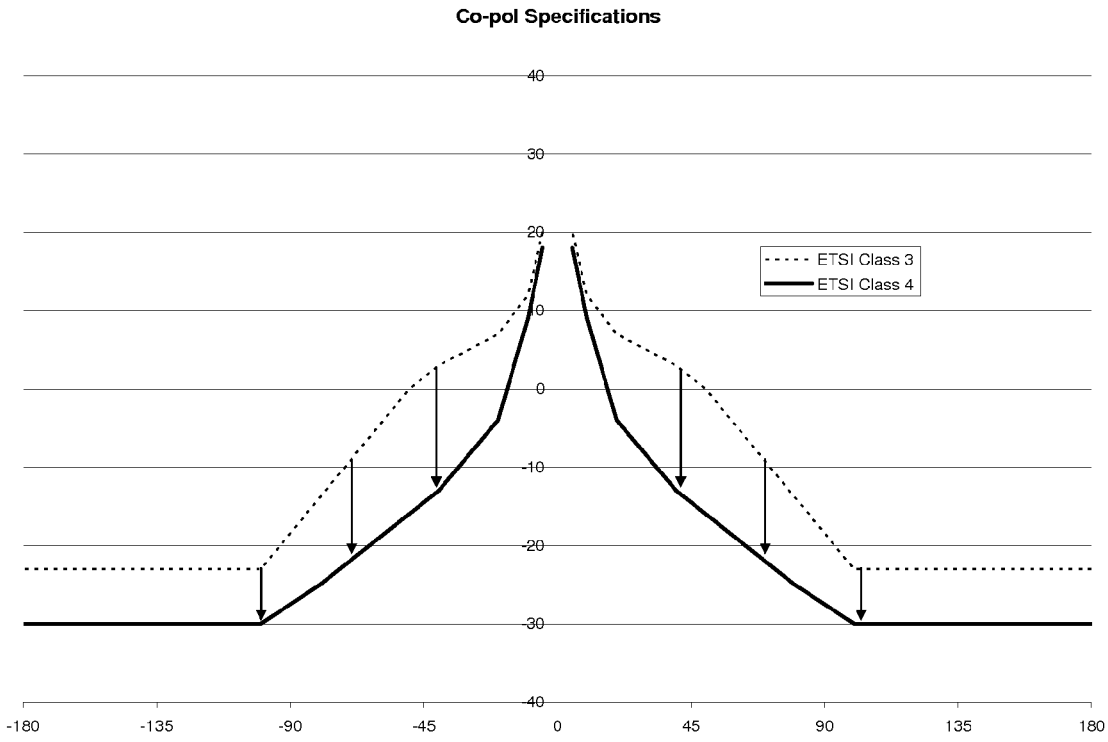
FIG. 1*a* is a schematic chart demonstrating differences between the requirements of the ETSI Class 3 and ETSI Class 4 Co-Polar Radiation Pattern Envelopes.
Figure 1B:
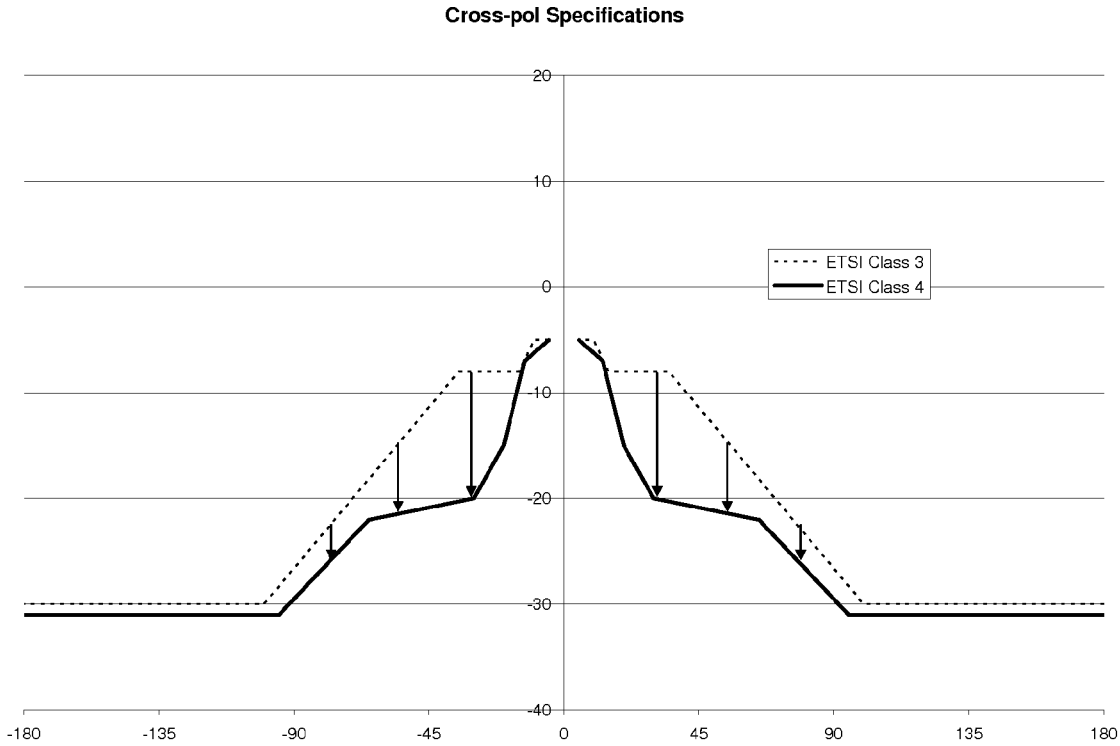
FIG. 1*b* is a schematic chart demonstrating differences between the requirements of the ETSI Class 3 and ETSI Class 4 Cross-Polar Radiation Pattern Envelopes.
Figure 1C:
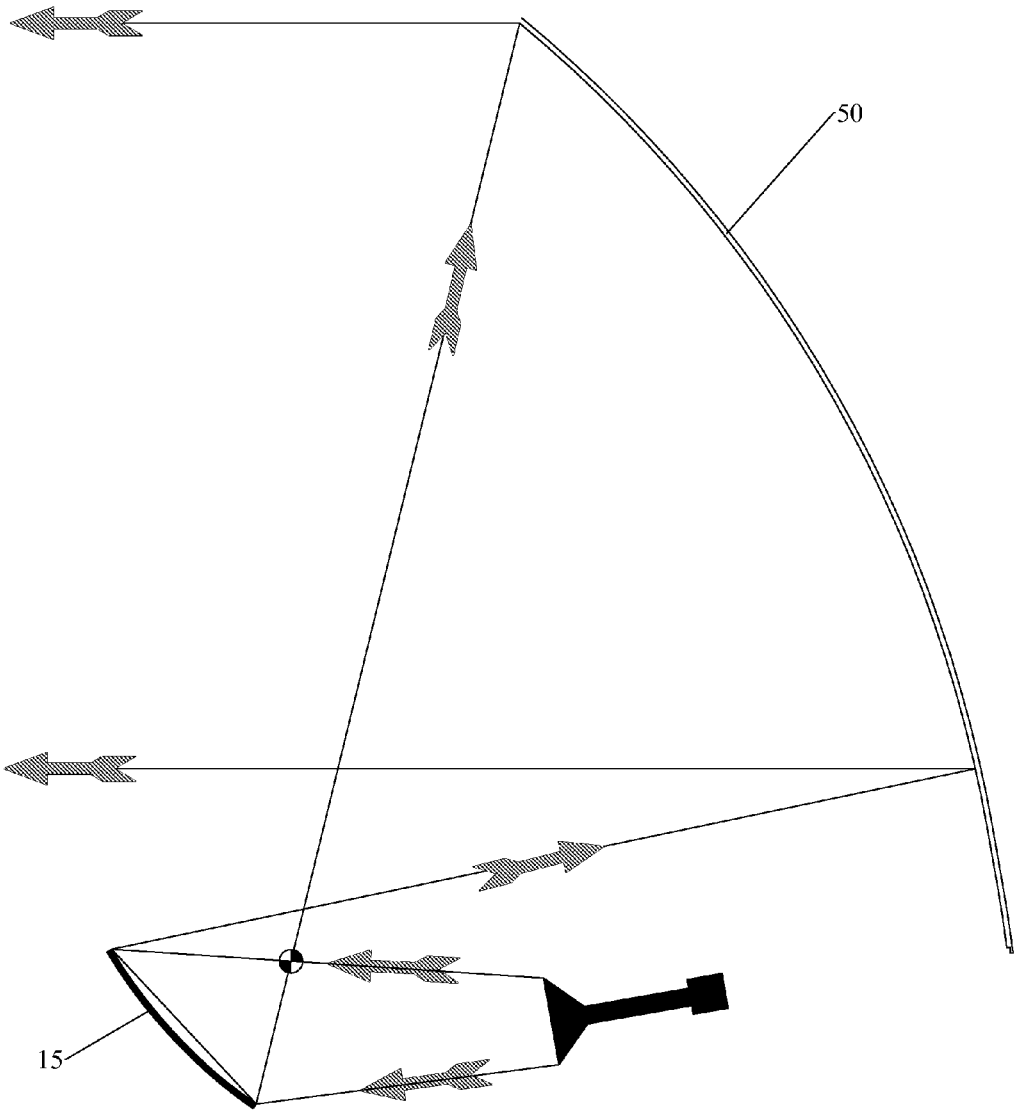
Prior Art Fig. 1c
FIG. 1*c* is a schematic signal path diagram of a typical prior art Gregorian dual reflector offset type reflector antenna.
Figure 2A:
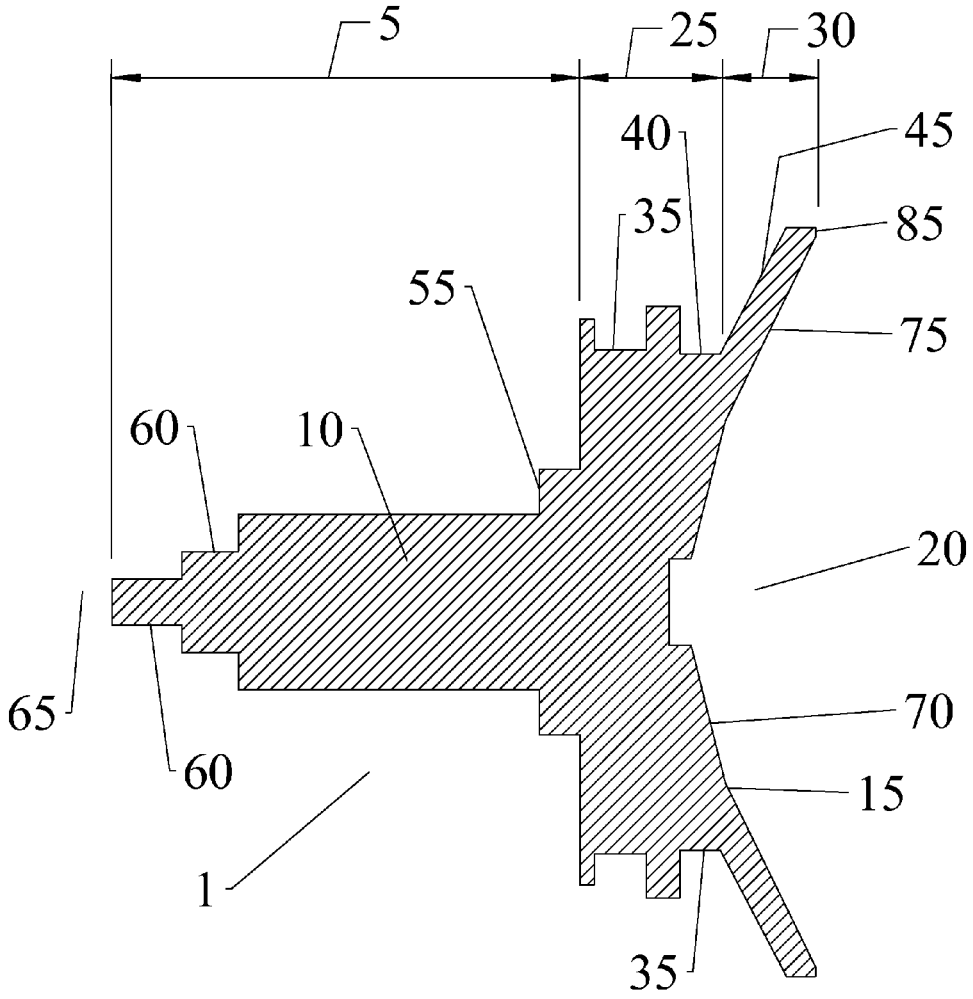
FIG. 2*a* is an schematic cut-away side view of an exemplary sub-reflector assembly.
Figure 2B:
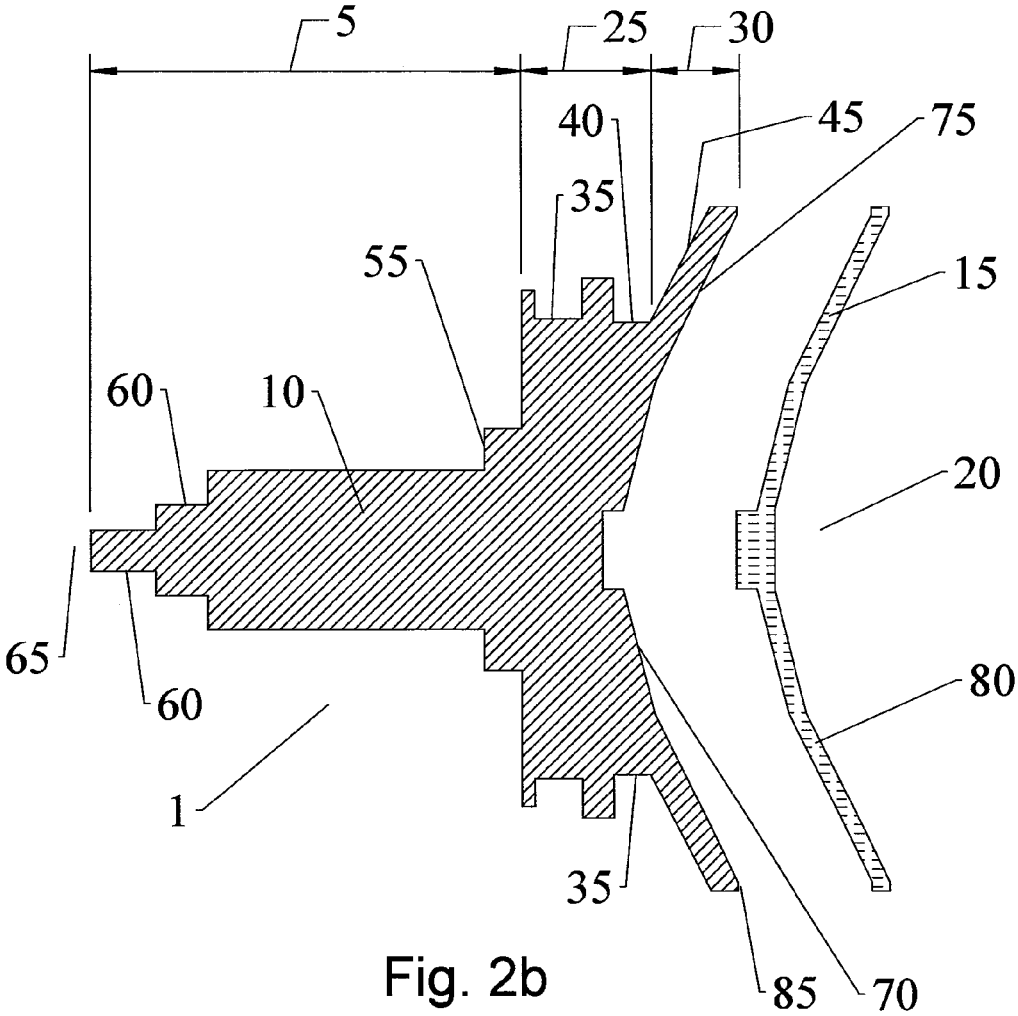
FIG. 2*b* is an exploded schematic cut-away side view of the sub-reflector assembly of FIG. 2*a*, demonstrated with a separate metal disc type sub-reflector.
Figure 3:
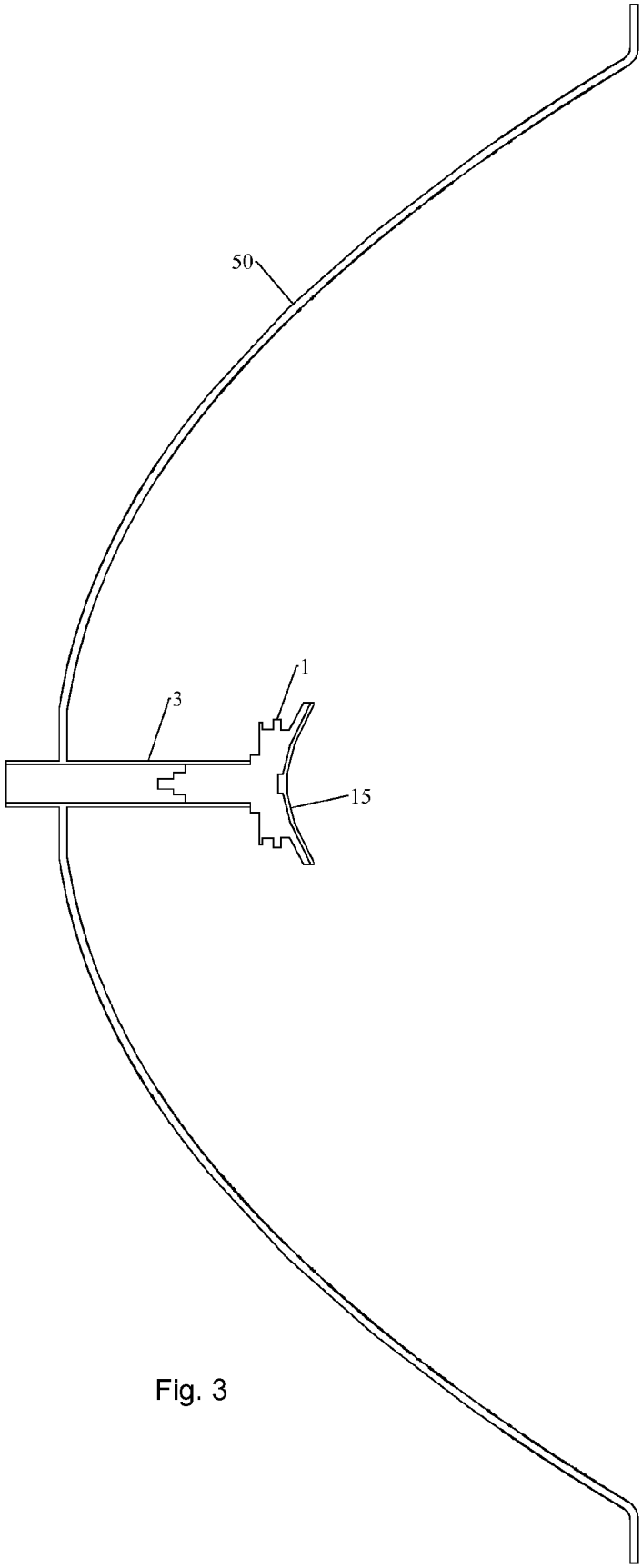
FIG. 3 is a schematic cut-away side view of the sub-reflector assembly of FIG. 2*b*, mounted within a 0.167 F/D deep dish reflector.

As shown in FIGS. 2*a*, 2*b* and 3, a cone radiator sub-reflector assembly 1 is configured to couple with the end of a feed boom waveguide 3 at a waveguide transition portion 5 of a unitary dielectric block 10 which supports a sub-reflector 15 at the distal end 20. The sub-reflector assembly 1 utilizes an enlarged sub-reflector diameter for reduction of sub-reflector spill-over. The sub-reflector 15 may be dimensioned, for example, with a diameter that is 2.5 wavelengths or more of a desired operating frequency, such as the mid-band frequency of a desired microwave frequency band. The exemplary embodiment is dimensioned with a 39.34 mm outer diameter and a minimum dielectric radiator portion diameter of 26.08 mm, which at a desired operating frequency in the 22.4 Ghz microwave band corresponds to 2.94 and 1.95 wavelengths, respectively.

Figure 4:
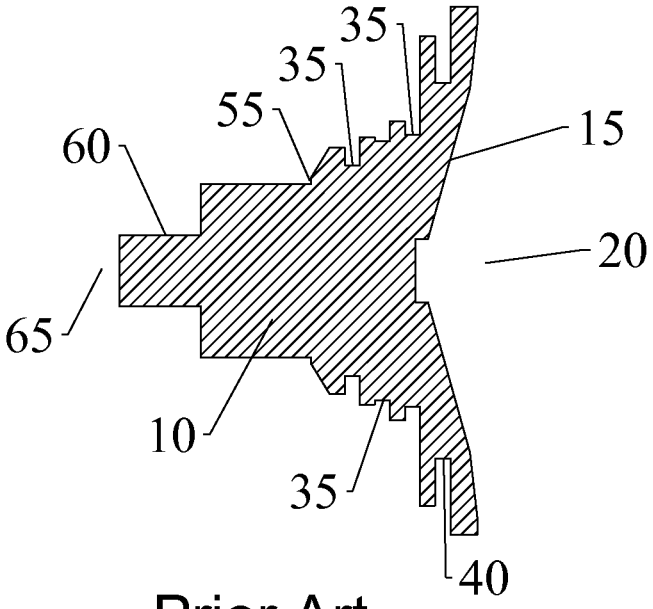
Prior Art Fig. 4
FIG. 4 is a schematic cut-away side view of a prior art dielectric cone sub-reflector assembly.
Figure 5:
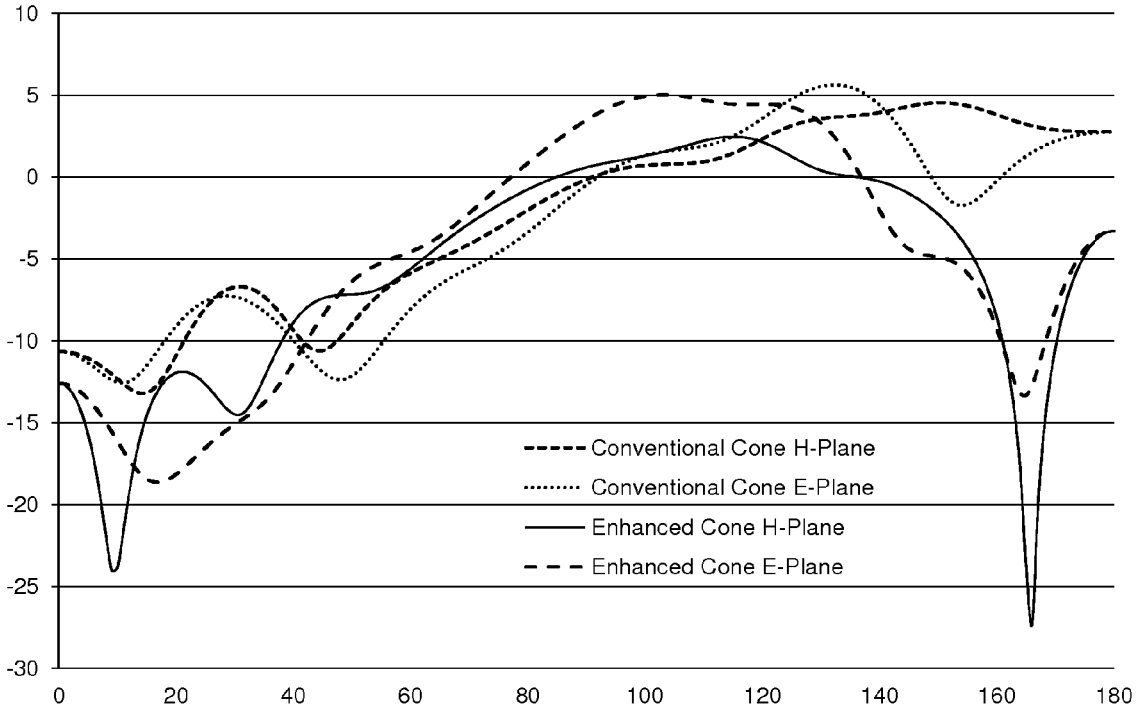
FIG. 5 is an E & H plane primary radiation amplitude pattern modeled comparison chart for the sub-reflector assemblies of FIG. 2*a* and FIG. 2*b* operating at 22.4 Ghz.

A dielectric radiator portion 25 situated between the waveguide transition portion 5 and a sub-reflector support portion 30 of the dielectric block 10 is also increased in size. The dielectric radiator portion 25 may be dimensioned, for example, with a minimum diameter of at least ⅗ of the sub-reflector diameter. The enlarged dielectric radiator portion 25 is operative to pull signal energy outward from the end of the waveguide 3, thus minimizing the diffraction at this area observed in conventional dielectric cone sub-reflector configurations, for example as shown in FIG. 4. The conventional dielectric cone has an outer diameter of 28 mm and a minimum diameter in a "radiator region" of 11.2 mm, which at a desired operating frequency in the 22.4 Ghz microwave band corresponds to corresponding to 2.09 and 0.84 wavelengths, respectively.

A plurality of corrugations are provided along the outer diameter of the dielectric radiator portion as radially inward grooves 35. In the present embodiment, the plurality of grooves is two grooves 35 (see FIGS. 2*a* and 2*b*). A distal groove 40 of the dielectric radiator portion 25 may be provided with an angled distal sidewall 45 that initiates the sub-reflector support portion 30. The distal sidewall 45 may be generally parallel to a longitudinally adjacent portion of the distal end 20; that is, the distal sidewall 45 may form a conical surface parallel to the longitudinally adjacent conical surface of the distal end 20 supporting the sub-reflector 15, so that a dielectric thickness along this surface is constant with respect to the sub-reflector 45.

The waveguide transition portion 5 of the sub-reflector assembly 1 may be adapted to match a desired circular waveguide internal diameter so that the sub-reflector assembly 1 may be fitted into and retained by the waveguide 3 that supports the sub-reflector assembly 1 within the dish reflector 50 of the reflector antenna proximate a focal point of the dish reflector 50, for example as shown in FIG. 3. The waveguide transition portion 5 may insert into the waveguide 3 until the end of the waveguide abuts a shoulder 55 of the waveguide transition portion 5.

The shoulder 55 may be dimensioned to space the dielectric radiator portion 25 away from the waveguide end and/or to further position the periphery of the distal end 20 (the farthest longitudinal distance of the sub-reflector signal surface from the waveguide end) at least 0.75 wavelengths of the desired operating frequency. The exemplary embodiment is dimensioned with a 14.48 mm longitudinal length, which at a desired operating frequency in the 22.4 Ghz microwave band corresponds to 1.08 wavelengths. For comparison, the conventional dielectric cone of FIG. 3 is dimensioned with 8.83 mm longitudinal length or 0.66 wavelengths at the same desired operating frequency.

One or more step(s) 60 at the proximal end 65 of the waveguide transition portion 5 and/or one or more groove(s) may be used for impedance matching purposes between the waveguide 3 and the dielectric material of the dielectric block 10.

The sub-reflector 15 is demonstrated with a proximal conical surface 70 which transitions to a distal conical surface 75, the distal conical surface 75 provided with a lower angle with respect to a longitudinal axis of the sub-reflector assembly 1 than the proximal conical surface 70.

As best shown in FIG. 2*a*, the sub-reflector 15 may be formed by applying a metallic deposition, film, sheet or other RF reflective coating to the distal end of the dielectric block 10. Alternatively, as shown in FIGS. 2*b* and 3, the sub-reflector 15 may be formed separately, for example as a metal disk 80 which seats upon the distal end of the dielectric block 10.

Figure 6:
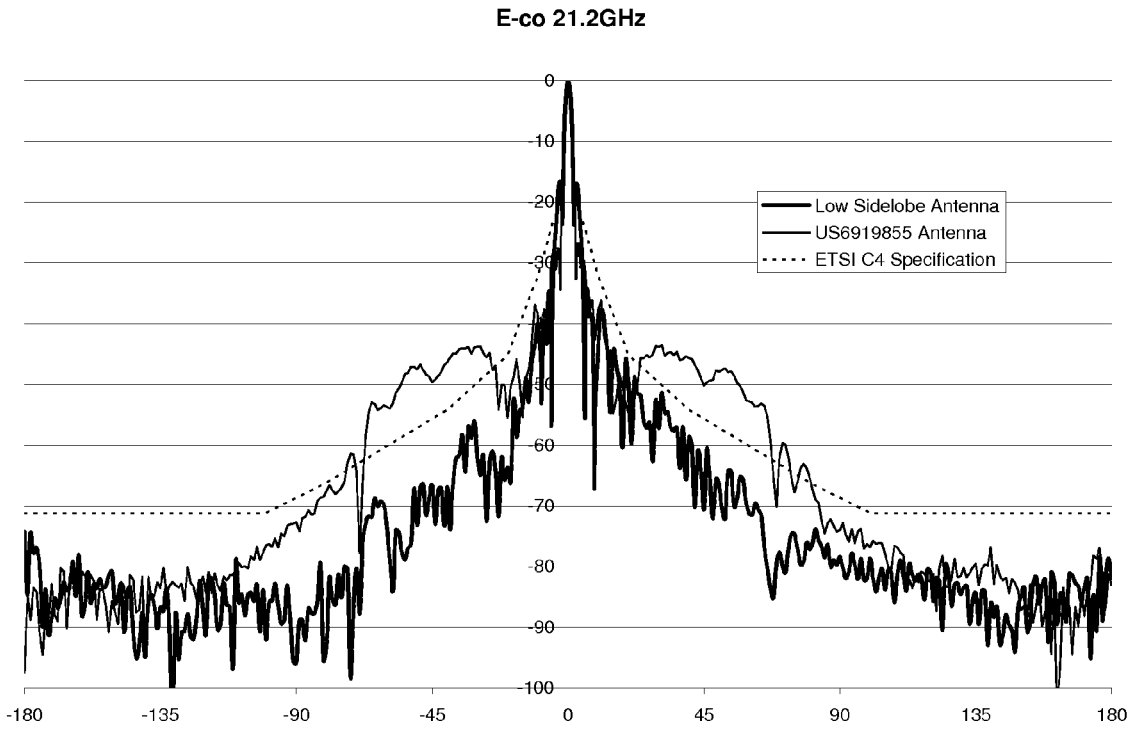
FIG. 6 is an E plane radiation pattern range data comparison chart for the sub-reflector assembly of FIG. 2*a* mounted within a 0.167 F/D dish reflector according to FIG. 10, compared to ETSI Class 4 RPE and U.S. Pat. No. 6,919,855.
Figure 7:
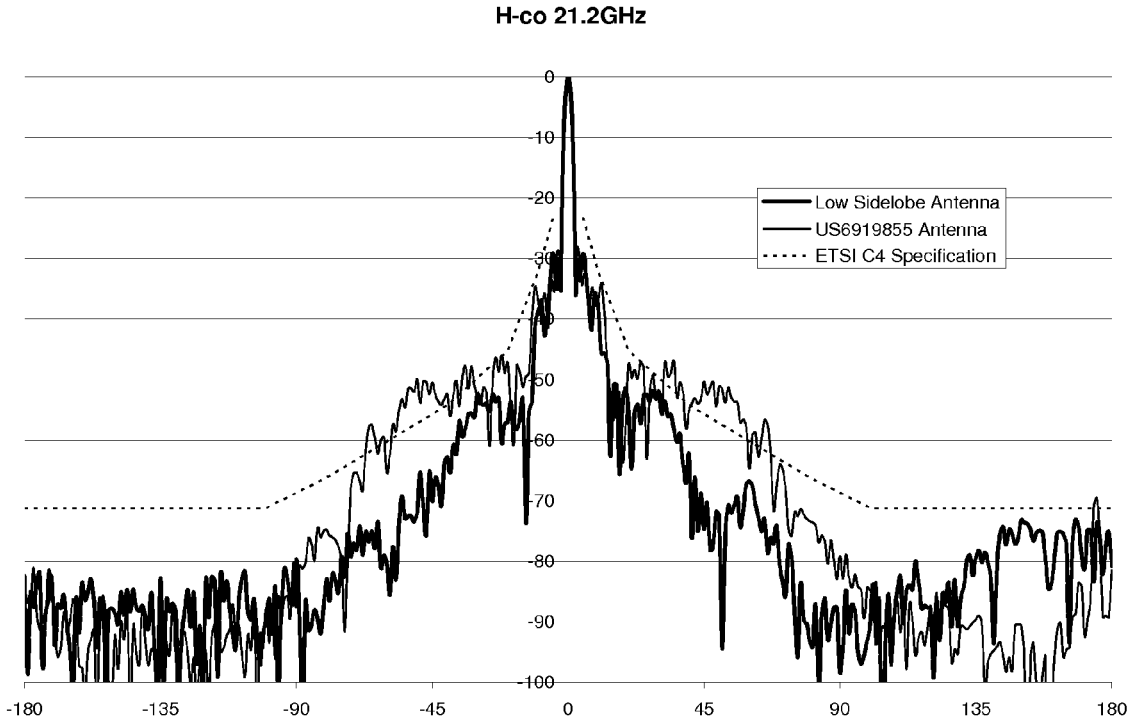
FIG. 7 is an H plane radiation pattern range data comparison chart for the sub-reflector assembly of FIG. 2*a* mounted within a 0.167 F/D dish reflector according to FIG. 10, compared to ETSI Class 4 RPE and U.S. Pat. No. 6,919,855.
Figure 10:
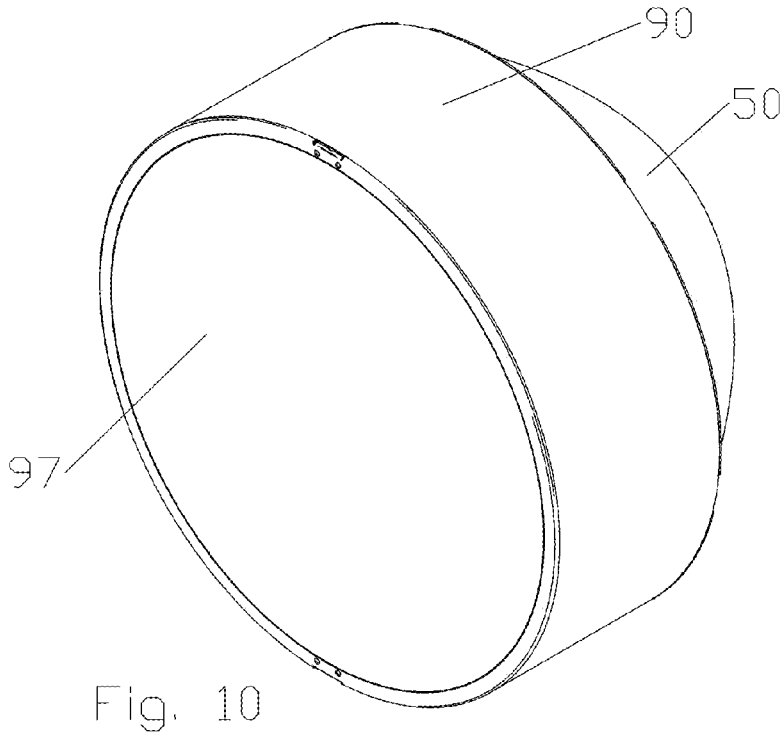
FIG. 10 is a schematic isometric view of an exemplary reflector antenna with a cylindrical shield.

When applied with an 0.167 F/D dish reflector 50 and shield 90, for example as shown in FIG. 10, the sub-reflector assembly 1 can provide surprising improvements in the signal pattern, particularly in the region between 20 and 60 degrees. For example, as shown in FIGS. 6 and 7, radiation in both the E & H planes is significantly reduced in the 20 to 60 degree region.

Figure 8:
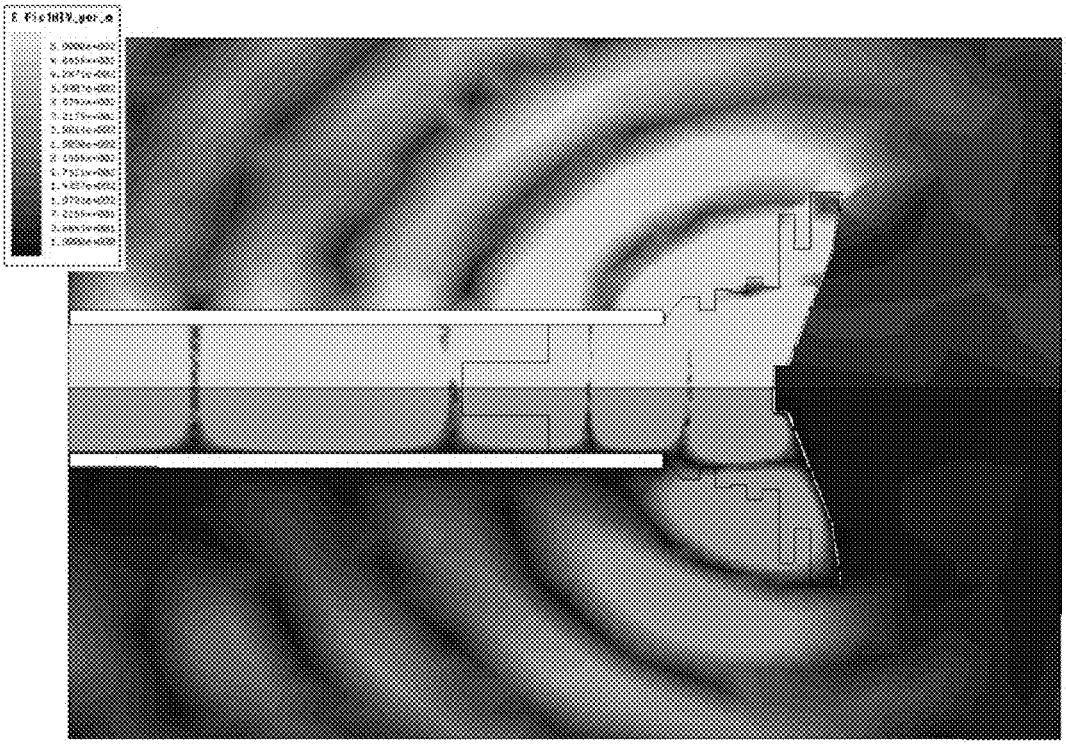
FIG. 8 is an E (top half) & H (bottom half) plane primary energy field distribution model for the sub-reflector assembly of FIG. 4.

FIG. 8 demonstrates a time slice radiation energy plot simulation of a conventional sub-reflector assembly, showing the broad angular spread of the radiation pattern towards the dish reflector surface and in particular the diffraction effect of the waveguide end drawing the signal energy back along the boresight which necessitates the limiting of the sub-reflector diameter to prevent significant signal blockage and/or introduction of electrical performance degrading secondary reflections/interference.

Figure 9:
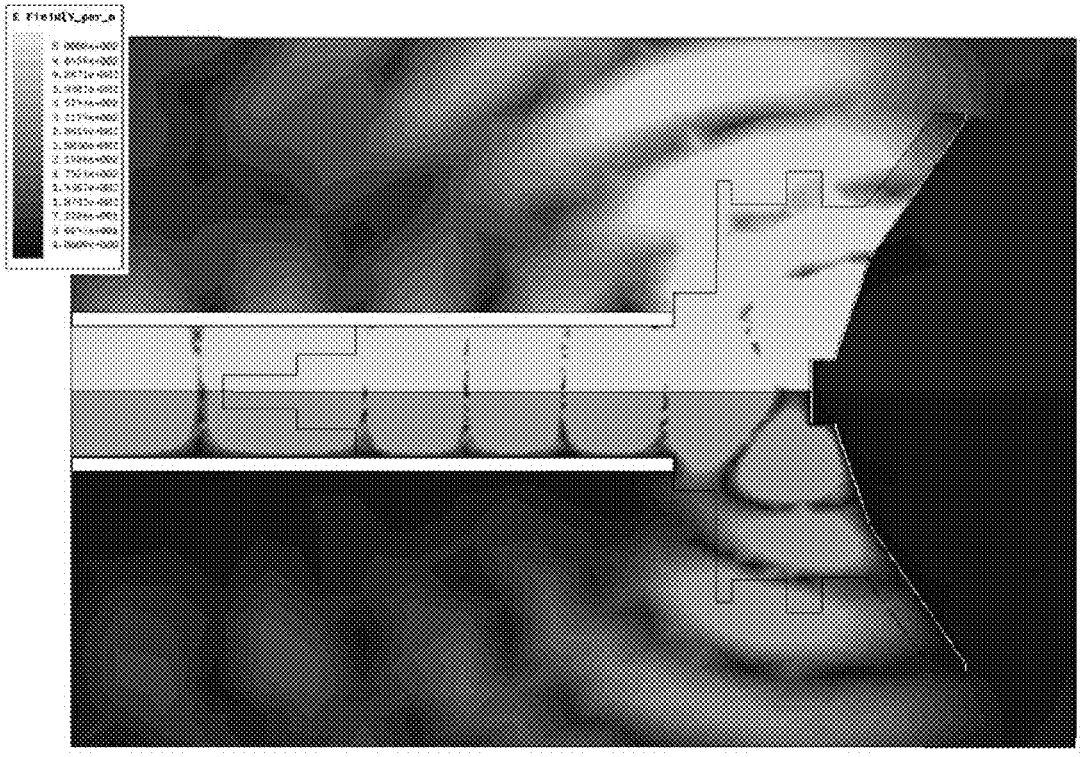
FIG. 9 is an E (top half) & H (bottom half) plane primary energy field distribution model for the sub-reflector assembly of FIG. 2*a*.

In contrast, FIG. 9 shows a radiation energy plot simulation of the exemplary controlled illumination cone radiator sub-reflector assembly 1 demonstrating the controlled illumination of the dish reflector 50 by the sub-reflector assembly 1 as the radiation pattern is directed primarily towards a mid-section area of the dish reflector 50 spaced away both from the sub-reflector shadow area and the periphery of the dish reflector 50. One skilled in the art will appreciate that, by applying a deep dish type dish reflector 50, the projection of the majority of the radiation pattern at an increased outward angle, rather than downward towards the area shadowed by the sub-reflector assembly 1, allows the radiation pattern to impact the mid-section of the dish reflector 50 without requiring the dish reflector 50 to be unacceptably large in diameter. However, as the F/D ratio decreases, the mid-section portion of the dish reflector 50 becomes increasingly narrow which begins to unacceptably limit overall antenna gain. The F/D ratio demonstrated in the exemplary embodiments herein is 0.167.

Where each of the shoulders 55, steps 60 and grooves 35 formed along the outer diameter of the unitary dielectric block are provided radially inward, manufacture of the dielectric block may be simplified, reducing overall manufacturing costs. Dimensioning the periphery of the distal surface as normal to the longitudinal axis of the assembly provides a ready manufacturing reference surface 85, further simplifying the dielectric block 10 manufacture process, for example by machining and/or injection molding.

By applying additional shielding and/or radiation absorbing materials to the periphery of the dish reflector 50, further correction of the radiation pattern with respect to the boresight and/or sub-reflector spill-over regions may be obtained in a trade-off with final antenna efficiency. Range measurements have demonstrated a 6-14% improved antenna efficiency (prime focus) for a cylindrical shielded ETSI Class 4 compliant Reflector Antenna over the U.S. Pat. No. 6,919,855 ETSI Class 3 type reflector antenna configuration, depending upon operating frequency.

Figure 11:
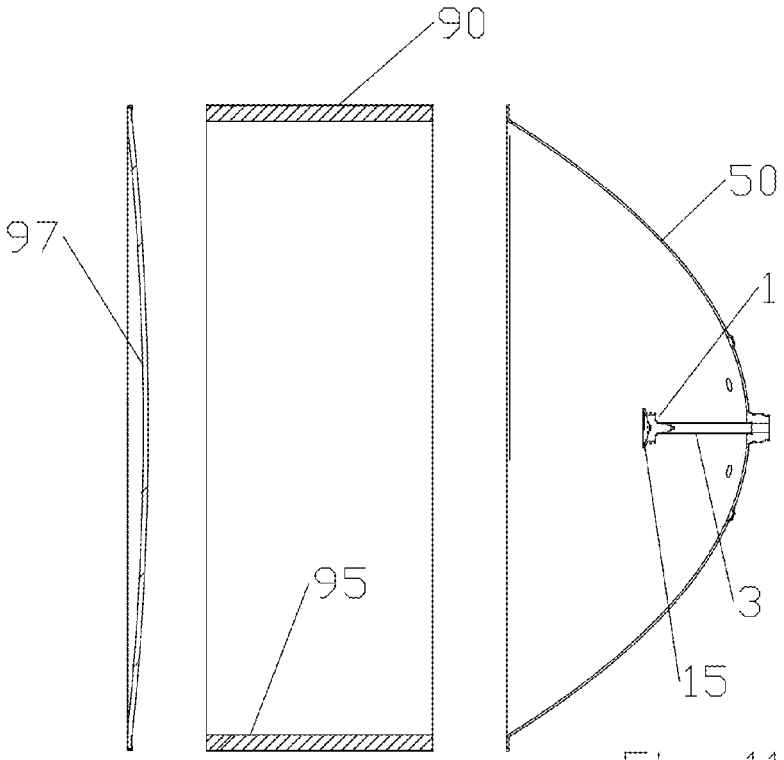
FIG. 11 is a schematic exploded cross-section view of the reflector antenna of FIG. 10.
Figure 12:
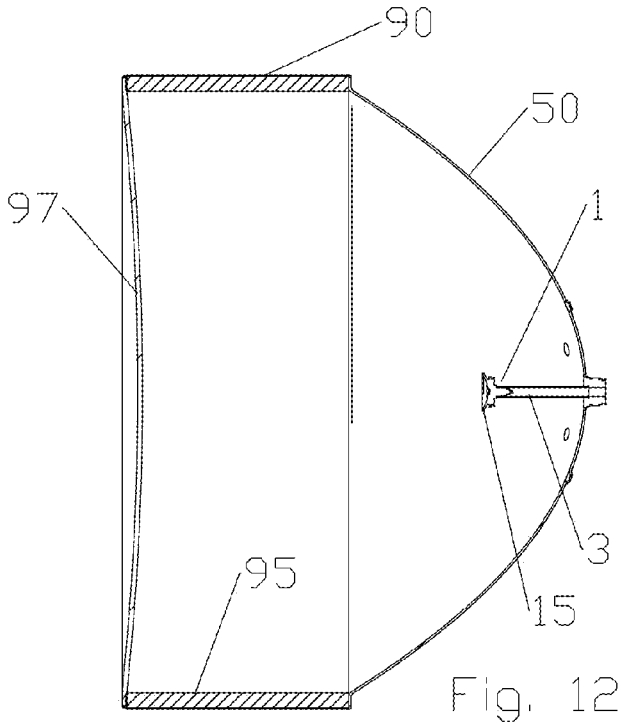
FIG. 12 is a schematic cross-section view of the reflector antenna of FIG. 10.
Figure 13:
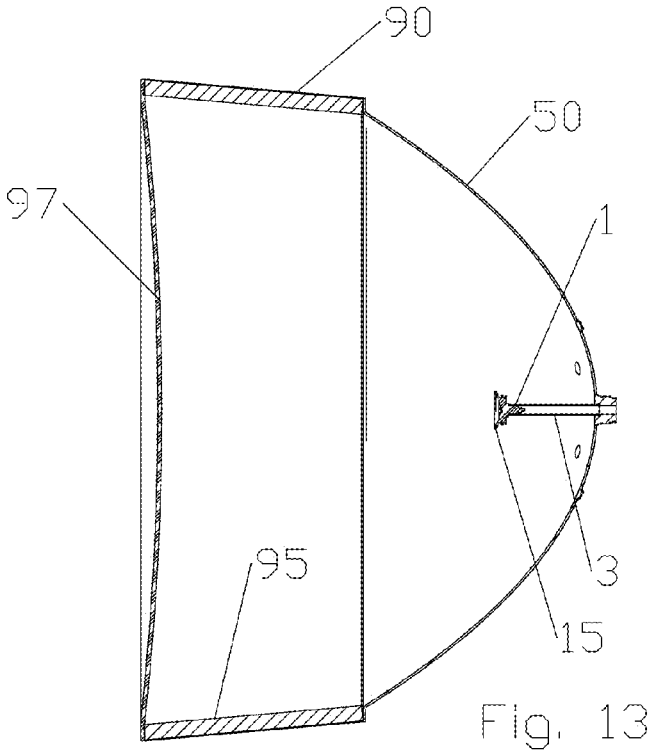
FIG. 13 is a schematic cross-section view of an exemplary reflector antenna with a cylindrical shield with an outward taper.
Figure 14:
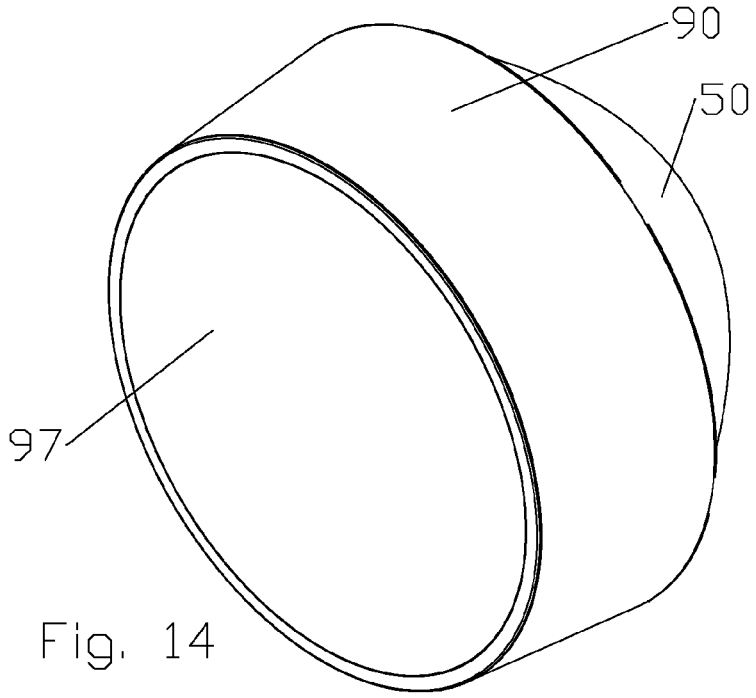
FIG. 14 is a schematic isometric view of an exemplary reflector antenna with a cylindrical shield with a 5° inward taper.
Figure 15:
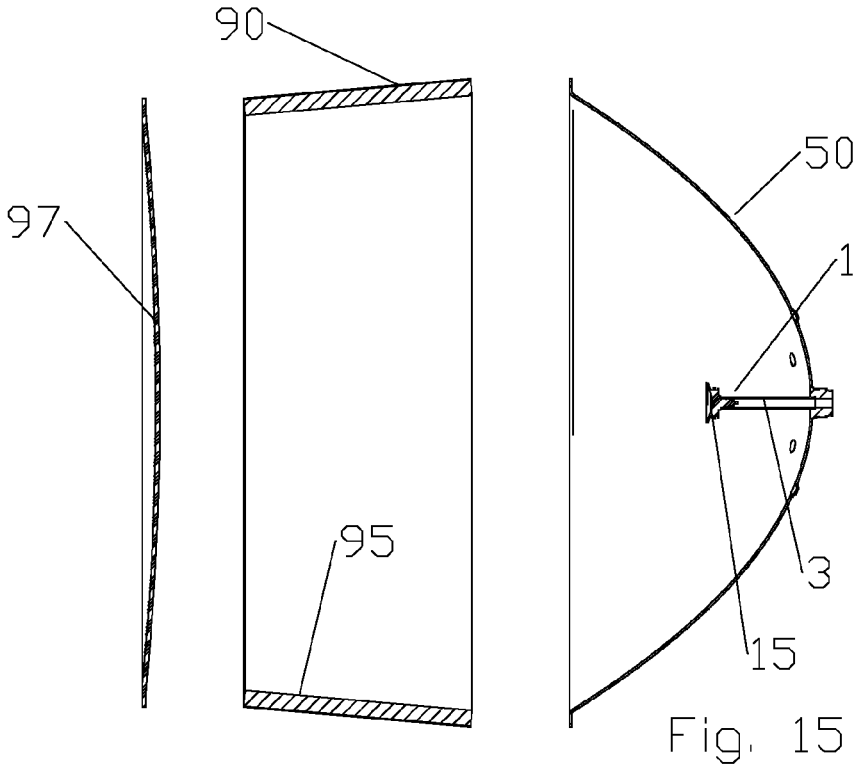
FIG. 15 is a schematic exploded cross-section view of the reflector antenna of FIG. 14.
Figure 16:
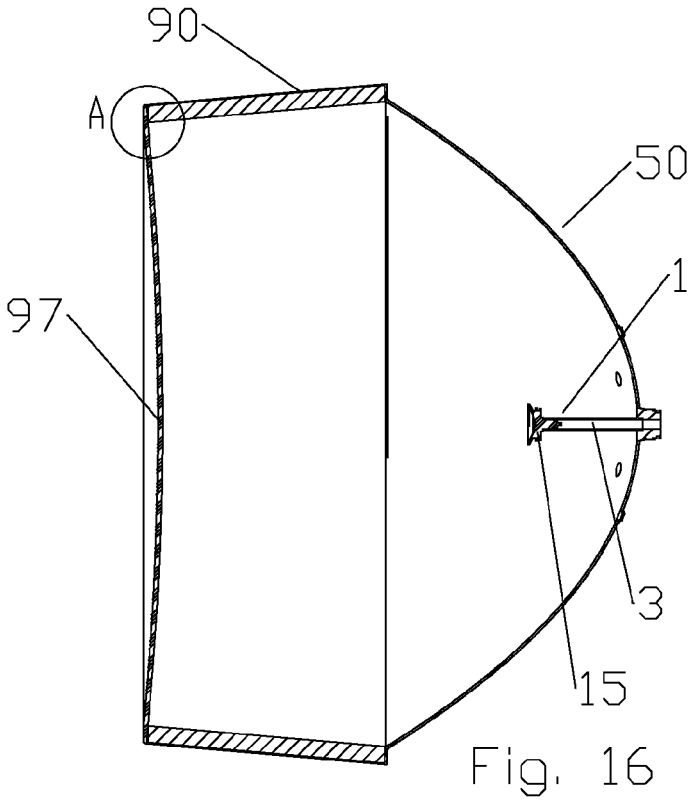
FIG. 16 is a schematic cross-section view of the reflector antenna of FIG. 14.
Figure 17:
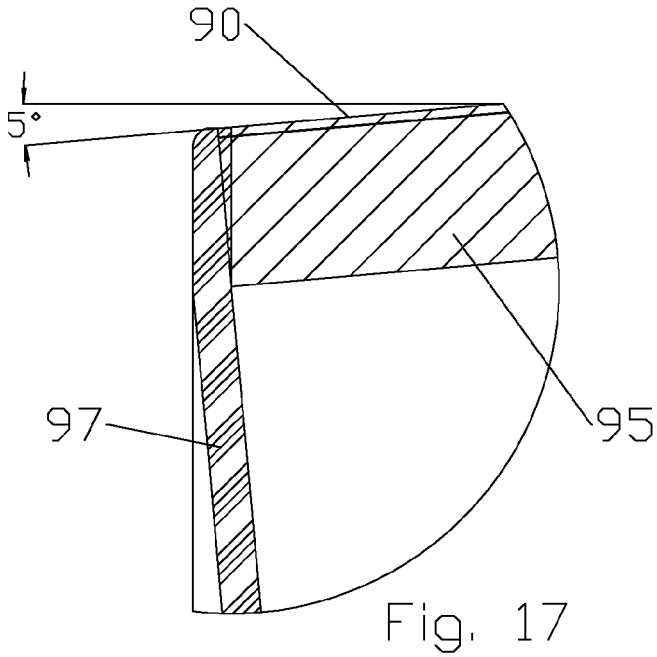
FIG. 17 is a close-up view of area A of FIG. 16.

As shown in FIGS. 10-12, shielding may be applied as a generally cylindrical shield 90 coupled to the periphery of the dish reflector 50. RF absorbing material 95 may be coupled to an inner diameter of the shield 90. The length of the shield may be selected with respect to the F/D of the dish reflector 50 and the radiation pattern in a trade-off with the total length of the resulting reflector antenna. For smaller F/D reflectors, shorter longitudinal length may be required due to feed position. The subtended angles between the dish reflector focal point and the dish reflector periphery for a 2 foot and a 4 foot diameter 0.167 F/D dish reflector 50 are in the range 40° to 50°. Also, the shield length is chosen dependent on the level of unwanted spillover energy from primary radiation patterns resulting from the sub-reflector assembly 1 configuration selected. Keeping this criterion, for the 2 ft and 4 ft examples, shield length may be, selected for example, to be 2 to 3 times the focal length of the dish reflector 50. The shield 90 may alternatively be applied with an outward taper, for example as shown in FIG. 13.

Figure 18:
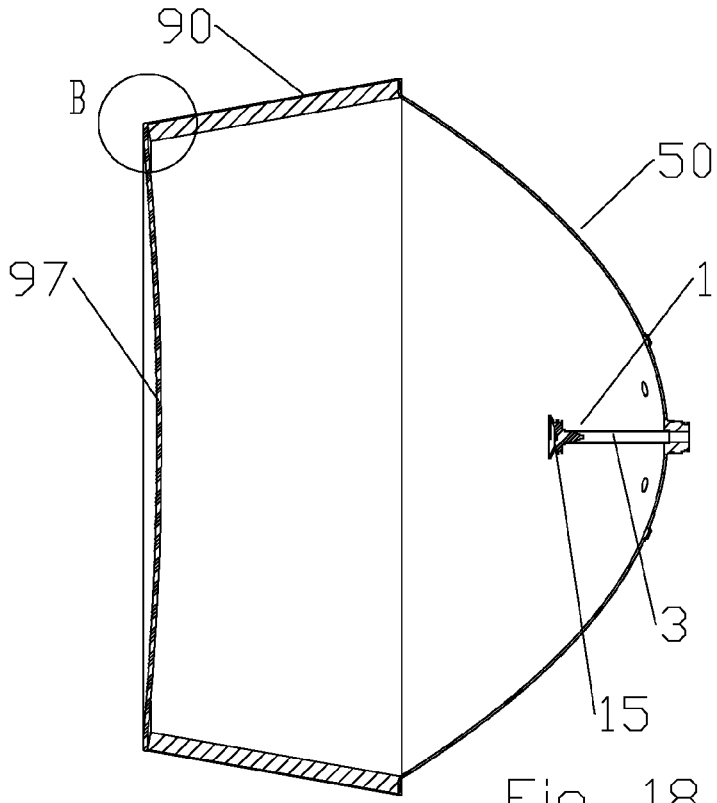
FIG. 18 is a schematic cross-section view of an exemplary reflector antenna with a cylindrical shield with a 10° inward taper.
Figure 19:
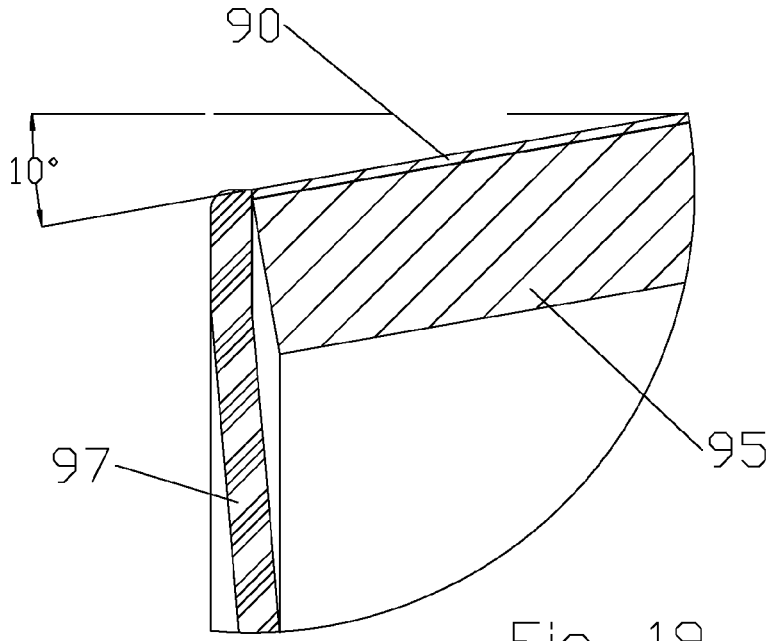
FIG. 19 is a close-up view of area B of FIG. 18.

As shown in FIGS. 14-19, in a radiation pattern trade-off between areas of concern where the radiation pattern approaches the desired radiation pattern envelope and areas where the radiation pattern is well below the required radiation pattern envelope, the radiation pattern may be further tuned by applying a radially inward taper so that the shield 10 becomes increasingly conical, for example with an angle greater than zero and up to 10 degrees with respect to a longitudinal axis of the reflector antenna (see FIGS. 18 and 19).

Figures 20, 21:
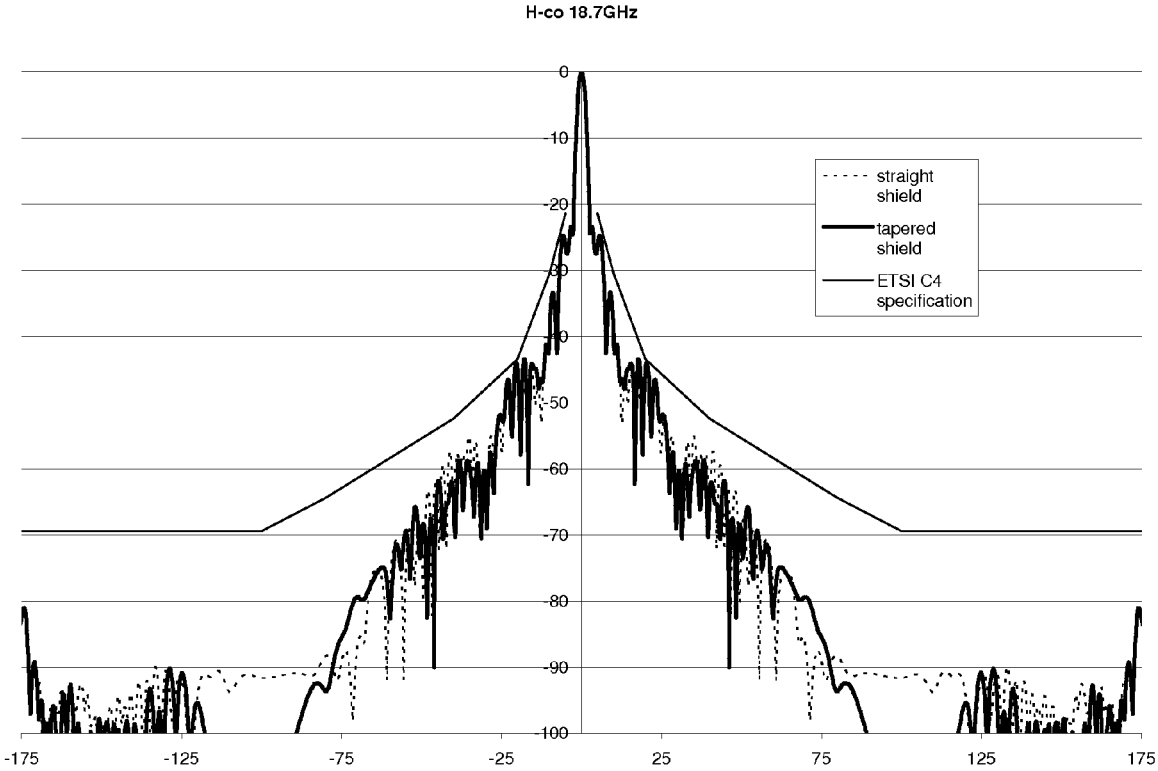
FIG. 20 is a calculated data chart of antenna efficiencies with respect to frequency and taper angle applied to the cylindrical shield.
FIG. 21 is an H plane radiation pattern range data comparison chart for the sub-reflector assembly of FIG. 2*a* mounted within a 0.167 F/D dish reflector with a cylindrical shield according to FIG. 10, compared to the same antenna assembly with a cylindrical shield with a 5° degree inward taper and the ETSI Class 4 RPE.

The maximum angle of the inward taper of the shield 10 may be selected at the point where the reduced distal end diameter of the shield 10 begins to block the signal, thereby unacceptably reducing the overall gain of the antenna. For example, comparing various shield geometries of a 2 ft diameter 18 GHz antenna (straight cylindrical shield, 5° taper in and 10° taper in), calculated efficiencies (%) are shown in FIG. 20. On average there is a 7% efficiency drop for a 2 ft diameter 18 GHz antenna with a 10° shield inward taper, compared to a straight shielded 2 ft 18 GHz antenna. An shield inward taper of approximately 5° may provide a balance of antenna performance in terms of radiation pattern improvement and antenna efficiency, as demonstrated by FIG. 21, where signal pattern improvement in the region of 30-50° is obtained in the Horizontal plane when the operating frequency is 18.7 Ghz, without unacceptably impacting other angles of concern.

From the foregoing, it will be apparent that the present invention may bring to the art a reflector antenna with improved electrical performance and/or significant manufacturing cost efficiencies. Because the front feed self-supported sub-reflector assembly reflector antenna has an axisymmetric antenna structure, the cost and complexity of the dual offset reflector antenna structure may be entirely avoided. The reflector antenna according to the invention may be strong, lightweight and may be repeatedly cost efficiently manufactured with a very high level of precision.

| Table of Parts | |
|---|---|
| 1 | sub-reflector assembly |
| 3 | waveguide |
| 5 | waveguide transition portion |
| 10 | dielectric block |
| 15 | sub-reflector |
| 20 | distal end |
| 25 | dielectric radiator portion |
| 30 | sub-reflector support portion |
| 35 | groove |
| 40 | distal groove |
| 45 | distal sidewall |
| 50 | dish reflector |
| 55 | shoulder |
| 60 | step |
| 65 | proximal end |
| 70 | proximal conical surface |
| 75 | distal conical surface |
| 80 | disk |
| 85 | reference surface |
| 90 | shield |
| 95 | RF absorbing material |
| 97 | radome |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A front feed reflector antenna, comprising:

a dish reflector with a reflector focal length to reflector diameter ratio of less than 0.25;

a wave guide coupled to a proximal end of the dish reflector, projecting into the dish reflector along a longitudinal axis;

a dielectric block coupled to a distal end of the waveguide;

a sub-reflector coupled to a distal end of the dielectric block; and a generally cylindrical shield coupled to the periphery of the dish reflector;

a diameter of the sub-reflector dimensioned to be 2.5 wavelengths or more of a desired operating frequency.

2. The antenna of claim 1, wherein a longitudinal distance between the distal end of the waveguide and the distal end at the sub-reflector periphery is at least 0.75 wavelengths of a desired operating frequency.

3. The antenna of claim 1, wherein the dielectric block is a unitary dielectric block provided with a waveguide transition portion, a dielectric radiator portion and a subreflector support portion;

the dielectric block coupled to the waveguide at the waveguide transition portion;

the dielectric radiator portion situated between the waveguide transition portion and the sub-reflector support portion; an outer diameter of the dielectric radiator portion provided with a plurality of radial inward grooves; a minimum diameter of the dielectric radiator portion greater than ⅗ of the sub-reflector diameter.

4. The antenna of claim 3, wherein the plurality of grooves is two grooves.

5. The antenna of claim 3, wherein a bottom width of the plurality of grooves decreases towards the distal end.

6. The antenna of claim 3, wherein the sub-reflector support portion extends from a distal groove of the dielectric radiator portion as an angled distal sidewall of the distal groove.

7. The antenna of claim 6, wherein the angled distal sidewall is generally parallel to a longitudinally adjacent portion of the distal end.

8. The antenna of claim 3, wherein the distal end of the dielectric block is provided with a proximal conical surface which transitions to a distal conical surface; the distal conical surface provided with a lower angle with respect to the longitudinal axis than the proximal conical surface.

9. The antenna of claim 8, wherein the sub-reflector support portion extends from a distal groove of the dielectric radiator portion as an angled distal sidewall of the distal groove; the angled distal sidewall generally parallel to the distal conical surface.

10. The antenna of claim 1, wherein the shield is tapered inward.

11. The antenna of claim 10, wherein the generally cylindrical shield is conical and tapered inward at an angle greater than zero and up to 10 degrees with respect to the longitudinal axis.

12. The antenna of claim 1, wherein an inner diameter of the cylindrical shield is provided with an RF absorbing material.

13. The antenna of claim 1, wherein a length of the shield is 2 to 3 times the reflector focal length to reflector diameter ratio of the dish reflector.

14. The antenna of claim 1, wherein the sub-reflector is a metal coating upon the distal end of the dielectric block.

15. The antenna of claim 1, wherein the generally cylindrical shield is conical and tapered inward at an angle of 5 degrees with respect to the longitudinal axis.

16. The antenna of claim 1, wherein a waveguide transition portion is dimensioned for insertion into the end of the waveguide until the end of the waveguide abuts a shoulder of the waveguide transition portion.

17. The antenna of claim 1, wherein the reflector focal length to reflector diameter ratio is 0.167 or less.

18. A method for manufacturing a front feed reflector antenna, comprising the steps of:

coupling a wave guide to a proximal end of a dish reflector, the dish reflector dimensioned with a reflector focal length to reflector diameter ratio of less than 0.25;

coupling a dielectric block to a distal end of the waveguide, a sub-reflector with a diameter dimensioned to be 2.5 wavelengths or more of a desired operating frequency coupled to a distal end of the dielectric block; and coupling a generally cylindrical shield coupled to the periphery of the dish reflector.

19. The method of claim 18, wherein a longitudinal distance between the distal end of the waveguide and the distal end of the dielectric block at the sub-reflector periphery is at least 0.75 wavelengths of a desired operating frequency.

20. The method of claim 18, wherein the shield is conical, tapered inward greater than zero and up to 10 degrees with respect to a longitudinal axis of the reflector antenna.

* * * * *